US005092517A

United States Patent [19]

Jeffries, Jr. et al.

[11] Patent Number: 5,092,517

[45] Date of Patent: Mar. 3, 1992

[54] SIGNALLING DEVICE FOR MAILBOX

[76] Inventors: James E. Jeffries, Jr., 3801 Fountain Ave.; William E. Harper, 801 Belvoir Hills Dr., both of, Chattanooga, Tenn. 37412

[21] Appl. No.: 687,567

[22] Filed: Apr. 19, 1991

[51] Int. Cl.[5] ..... B65D 91/00

[52] U.S. Cl. ..... 232/35; 232/39

[58] Field of Search ..... 232/17, 35, 34, 36, 232/39, 38

[56] References Cited

U.S. PATENT DOCUMENTS

| | | | |
|---|---|---|---|
| 834,122 | 10/1906 | Gordon | 232/34 |
| 1,197,713 | 9/1916 | Decker | 232/34 |
| 3,722,460 | 3/1973 | James | 232/35 |
| 3,750,939 | 8/1973 | Hallett | 232/35 |
| 4,066,209 | 6/1978 | Brake | 232/35 |
| 4,150,780 | 4/1979 | Mapes | 232/35 |
| 4,205,778 | 6/1980 | File | 232/35 |
| 4,318,507 | 3/1982 | Thopsey | 232/35 |
| 4,706,880 | 11/1987 | Peters | 232/35 |
| 4,877,180 | 10/1989 | Shull | 232/35 |

*Primary Examiner*—Renee S. Luebke
*Assistant Examiner*—F. Saether
*Attorney, Agent, or Firm*—John C. Garvin, Jr.

[57] ABSTRACT

A signalling device for attachment to a rural type mailbox mounted on the side of a road for alerting the owner of the mailbox that mail has been deposited therein by the mail carrier. The signalling device includes a flag plate pivotally secured to either the mailbox or a support post which is actuated by the opening of the door of the mailbox to cause the flag plate to fall, due to gravity, from a raised, non-signalling, position to a lowered, signalling, position. After the mail is removed from the mailbox, the flag plate is easily raised to reset the signalling device in its raised, non-signalling, position to be reactuated by the mail carrier when he next delivers the mail.

17 Claims, 7 Drawing Sheets

SIGNALLING DEVICE FOR MAILBOX

BACKGROUND OF THE INVENTION

The invention of the present application relates to mailboxes of the rural type which are normally mounted along the side of a road or highway, and is particularly concerned with a signal associated with such mailboxes which will inform the owners of the mailboxes that mail has been deposited therein.

It is common for mailboxes in rural areas to be located at a considerable distance from the residence of the owner. Since it is normally not feasible to keep a continuous watch on the box and since a comparatively long trip will be required, where the distance from the highway or road to the house is great, to determine whether the mail has been delivered, it is desirable to have means associated with the mailbox whereby a resident can be informed that mail has been placed in the mailbox by the mail carrier; this is especially so where the owner of the mailbox is handicapped or disabled.

Without a signalling device of some sort it becomes necessary for the owner of the mailbox, when he does not see the mail carrier, to actually open the door of the mailbox to determine whether or not mail has been deposited therein. In view of this, there has been a number of proposals for automatic signalling devices to indicate when the door of the mailbox has been opened, this being an indication that mail has been delivered to the mailbox since the mail carrier is ordinarily the only person other than the recipient of mail (the owner of the mailbox or a member of his family) to open the mailbox under normal circumstances.

A partial search of the United States patents in this area has disclosed a number of such devices. Such devices have not been widely accepted even though the intended devices would provide a substantial convenience to people who have mailboxes mounted some distance from the house adjacent a road or highway. Accordingly, it is believed that there is a need to provide a signalling device for rural type mailboxes which is practical, reliable, easy to install and operate, and of a design which is relatively economical to manufacture.

A partial search of the U.S. Patents disclosed a large number of devices for use with rural type mailboxes to convey to the owner of a mailbox that the mail carrier had made a delivery to the mailbox. U.S. Pat. Nos. 3,318,516, 4,005,816, 4,147,292, 4,182,479, 4,205,778, 4,382,541, 4,491,268, 4,492,335, 4,524,905, 4,570,846, 4,655,390, 4,711,391, 4,728,028, 4,738,392, 4,754,918, 4,756,472, 4,759,496, 4,778,103, 4,793,552, 4,798,326, and 4,811,895 are illustrative of such prior art devices.

Many of these prior art devices are of complicated construction, and thus are expensive and subject to failure. Several of these prior art devices are not adapted to be readily retrofit to existing mailboxes while others are difficult to reset, and thus difficult to use. The instant invention overcomes the numerous disadvantages and deficiencies of the prior art devices.

It is an object of the present invention to provide a signalling device for rural type mailboxes which can be easily installed on an existing mailbox, which can operate reliably and effectively, which does not interfere with the normal operation of the mailbox, and which has a design which lends itself to economical manufacture.

It is a further object of the present invention to provide a signalling device which can be easily mounted on a conventional mailbox with minimal damage, if any, to the structural integrity of the mailbox.

It is yet a further object of the present invention to provide a readily attachable and detachable signal device for a mailbox which is automatically tripped when the mailbox door is opened so that a signal is given to the owner of the mailbox that mail has been deposited in the box.

The present invention satisfies these objects by providing a self-contained mailbox signalling device for attachment to a standard mailbox.

DESCRIPTION OF THE INVENTION

Figure 1:
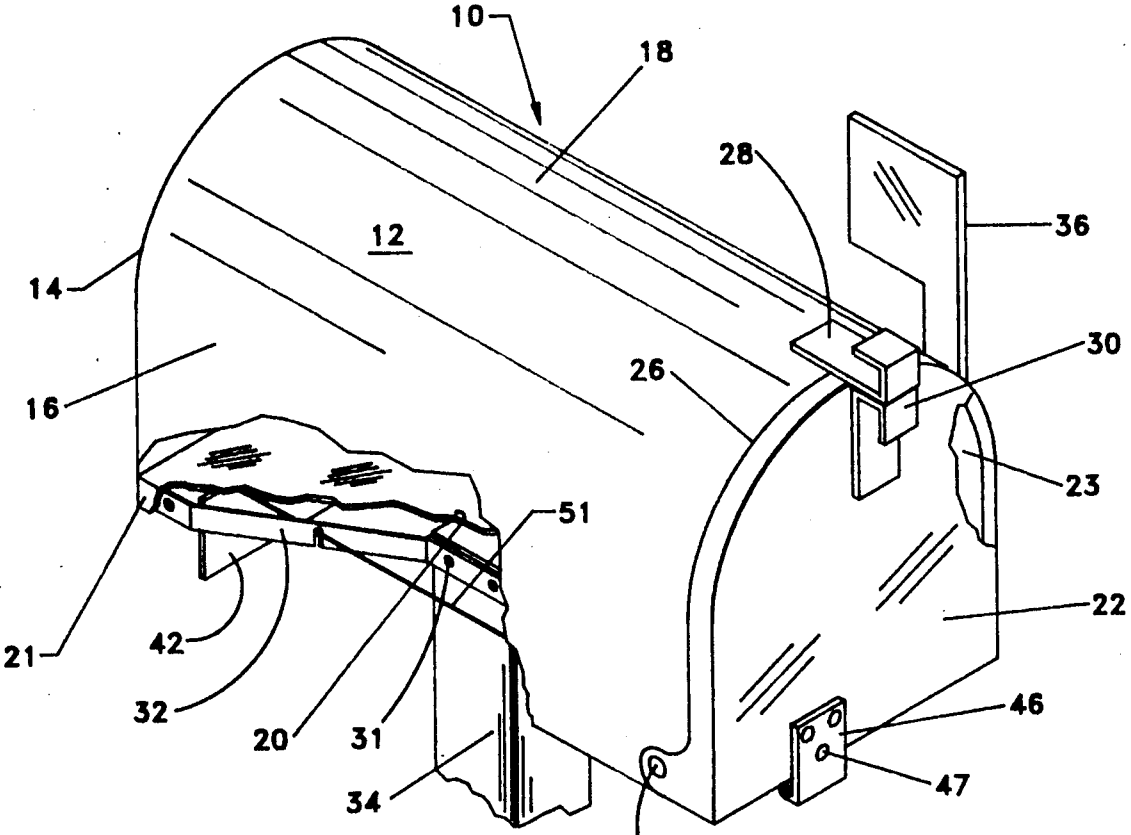
FIG. 1 is a partially broken away perspective view of a rural type mailbox shown mounted on a post and provided with one embodiment of the signal device of the present invention.

FIG. 1 shows, in perspective, a typical rural mailbox 10 comprising an elongated body portion 12 having a back wall 14, two side walls 16, a curved top wall 18, a raised floor or bottom 20 having downwardly extending flanges 21, an open front end 23, and a swinging door 22 pivotally or hingedly mounted at 24 to the lower front edge portion of the two side walls 16. The door 22 has a peripheral lip or flange 26 which extends rearwardly from the upper and side edges of the door 22. With the door 22 in its closed position, the lip or flange 26 extends rearwardly a short distance around the outer surface of the forward portions of the side walls 16 and top wall 18 of box 10. Cooperating catch devices 28 and 30 are attached to the top wall 18 and door 22, respectively, and these engage one another to releasably hold the door 22 in its closed position.

The components 10 through 30 described thus far are those which exists in many, if not most, conventional rural type mailboxes currently in use. Mailbox 10 may be supported in any suitable manner, for example, by securing the floor or bottom 20 of body portion 12 by suitable means such as bolts 31 to a bracket 32 or other conventional means carried on the upper end of a post 34, the lower end of which can be secured in the ground. As shown in FIG. 1, mailbox 10 is provided with the conventional flag 36 used to inform the mail carrier that the box contains mail ready for posting.

As will be disclosed more fully in the following detailed description, the present invention is particularly adapted to be used in an especially convenient manner with such conventional mailboxes, mounted on the bottom, or either side of, or to the rear of such mailboxes, not only with ease of installation with minimal tools, but also with effective and reliable use to alert the owner that the box contains mail delivered by the mail carrier.

Figure 2:
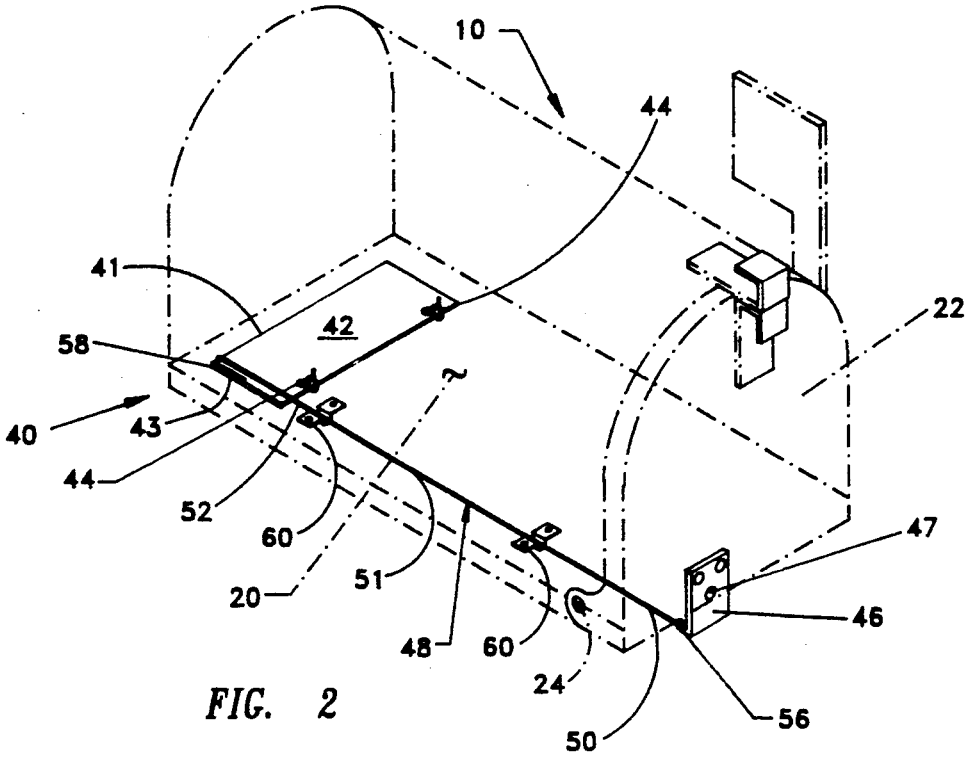
FIG. 2 is a pictorial view of a rural type mailbox provided with the embodiment of the signal device shown in FIG. 1, prior to the opening of the mailbox by the mail carrier, with the flag and operating mechanism of the signal device being shown in solid lines in a raised or non-signalling position and the mailbox being shown in dot-dash lines.
Figure 3:
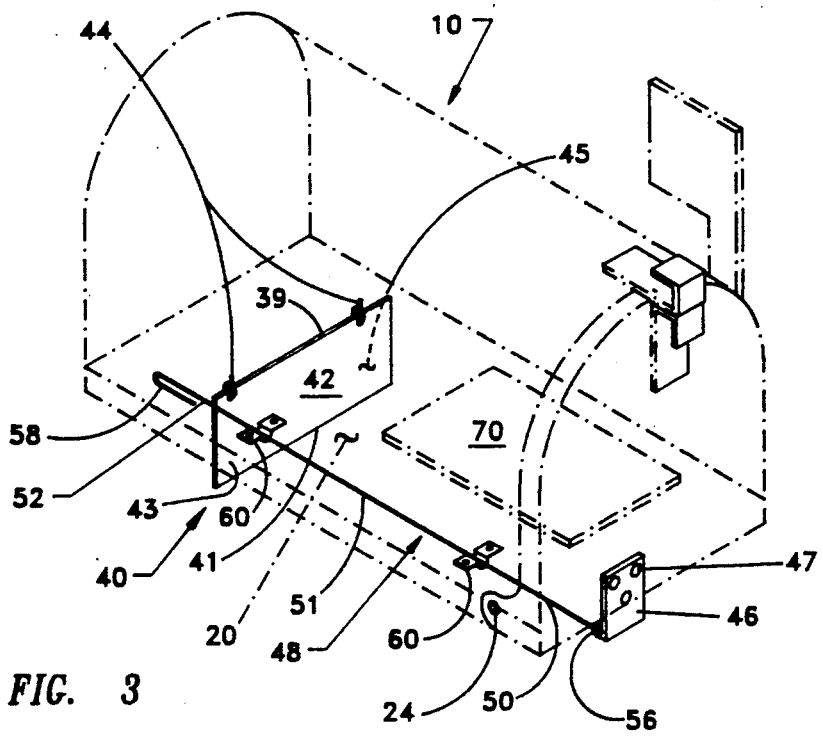
FIG. 3 is a pictorial view similar to FIG. 2 with the door of the mailbox being in a closed position, after mail has been placed into the mailbox by the mail carrier, and showing the signal device in a released or signalling position.
Figure 5:
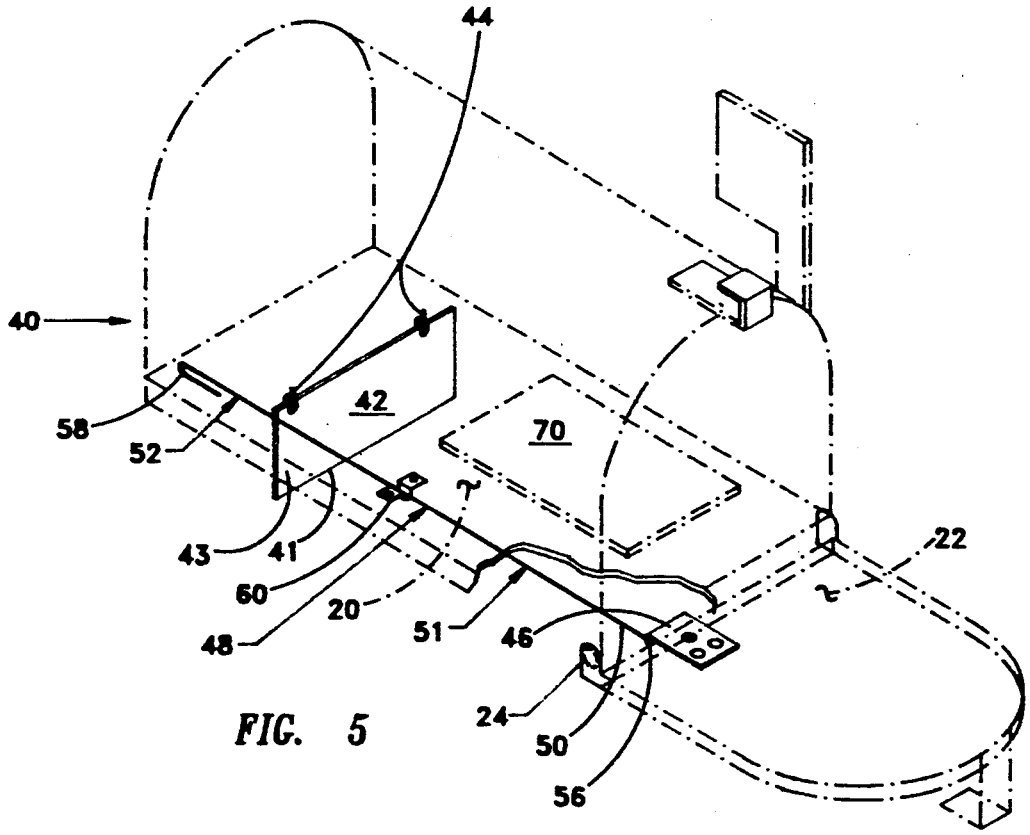
FIG. 5 is a pictorial view similar to FIG. 2 with the door of the mailbox being in an opened position for receipt of mail into the mailbox, and showing the signal device of FIG. 1 in a released or signalling position.
Figure 8:
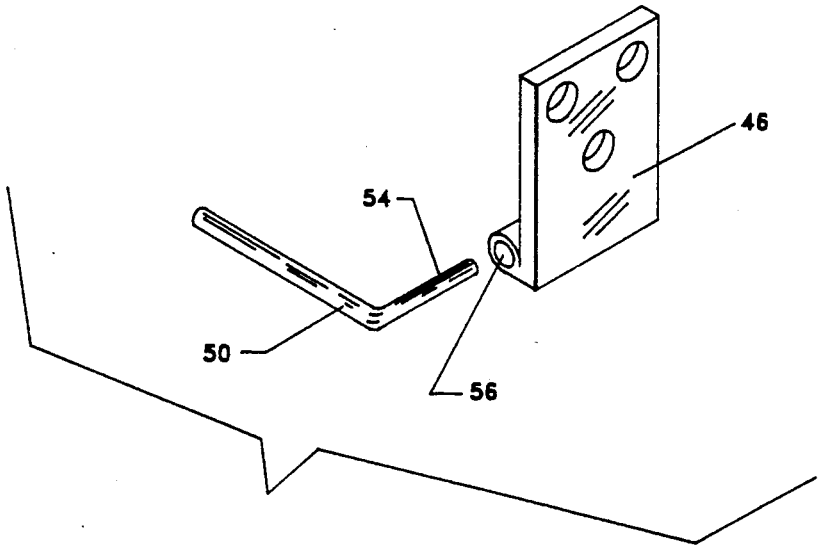
FIG. 8 is an exploded view of the half hinge member and the distal end of the rigid actuating wire incorporated in the embodiment of the signal device of the present invention as illustrated in FIGS. 1-3 and 5.

The embodiment of the signalling device as best illustrated in FIGS. 2, 3 and 5 is generally designated by reference numeral 40 and comprises a flag plate 42 having substantially parallel edges 39 and 41 and opposed surfaces 43 and 45, a pair of hinges 44 secured to edge 39 of flag plate 42 and to the lower surface of floor or bottom 20 of mailbox 10, a half hinge member 46 secured by rivets or screws 47 or any other conventional means to the lowermost portion of door 22, a rigid rod or wire 48 having a first end 50 and a second end 52, the first end 50 of rigid rod or wire 48 being bent at right angle to form a bearing 54 (FIG. 8) for insertion into opening 56 (FIG. 8) in half hinge member 46, the second end 52 of rod 48 being bent upon itself to form a hook 58, and a plurality of guide members 60 secured to floor or bottom 20 of mailbox 10 for supporting and guiding the intermediate portion 51 of rod 48. The opening 56 in half hinge member 46 is located in front of and lower than pivot point 24 as best illustrated in FIGS. 1-3 and 5.

Figure 4:
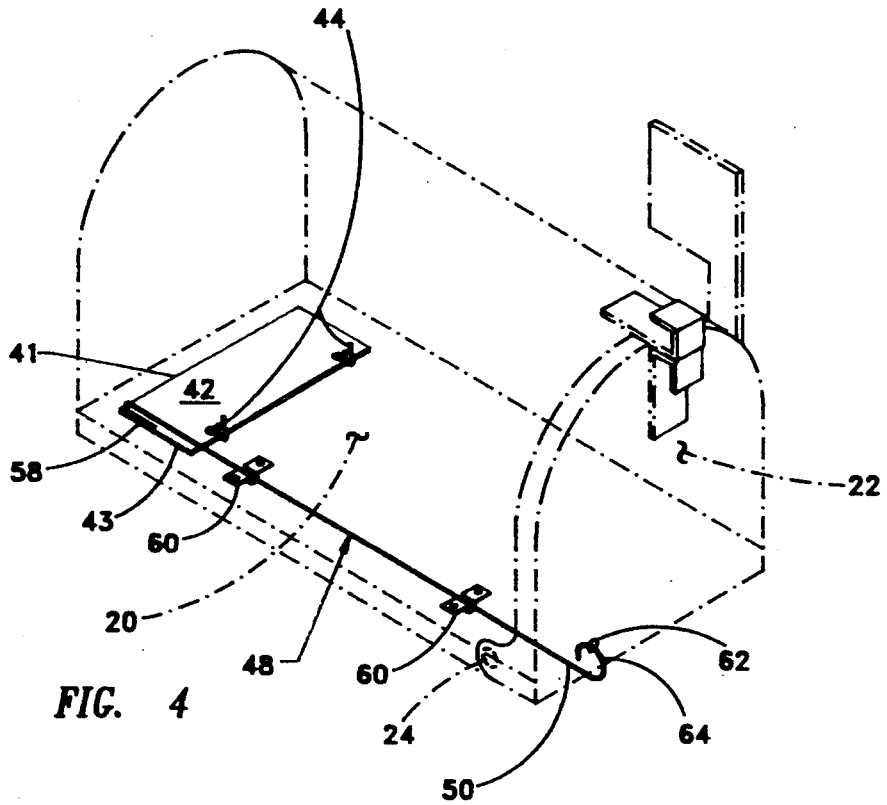
FIG. 4 is a pictorial view of a rural type mailbox provided with another embodiment of the signal device, prior to the opening of the mailbox by the mail carrier, with the flag and operating mechanism being shown in solid lines in a raised or non-signalling position and the mailbox being shown in dot-dash lines.

The embodiment of the signal device as illustrated in FIG. 4 is identical to that shown in FIGS. 2, 3 and 5 except for the manner in which the first end 50 of rigid rod or wire 48 is attached to the lowermost portion of the door 22. In this embodiment, the lowermost portion of door 22 is provided with an opening 62 in lieu of half hinge member 46 and first end 50 of rod 48 is bent to form a generally circular hook 64 for engagement with the walls of opening 62 in the lowermost portion of door 22.

Figure 9:
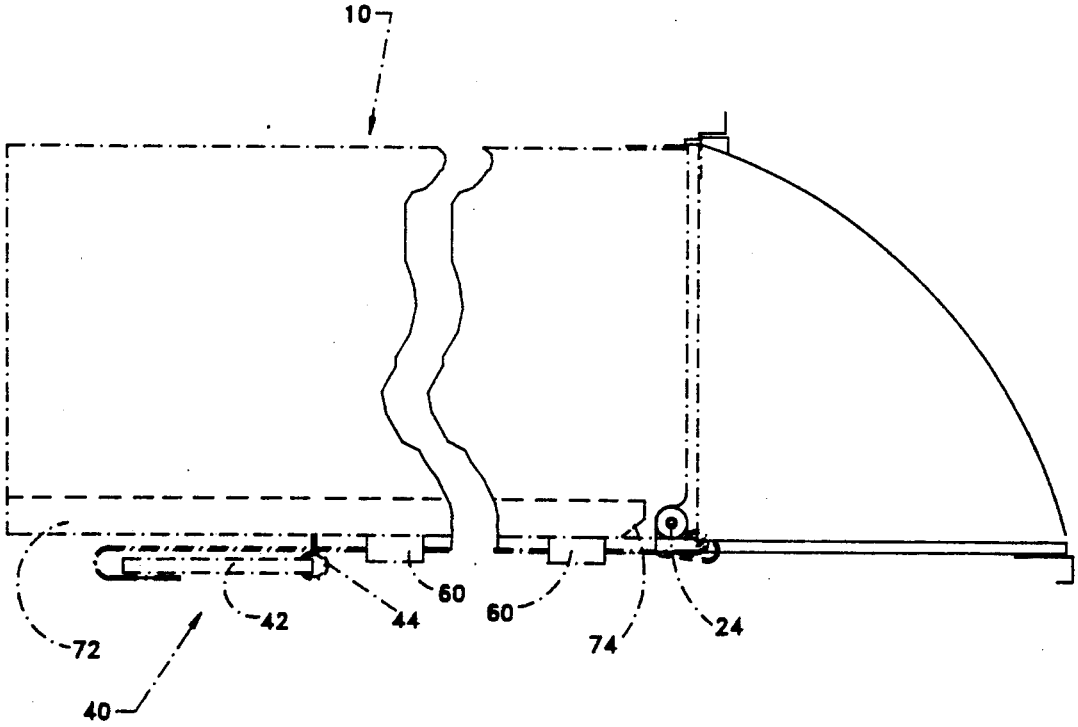
FIG. 9 is a partially broken away side view of another embodiment of the signal device as illustrated in FIG. 4 with a wooden board fixed to the lower surface of the bottom of the mailbox.
Figure 7:
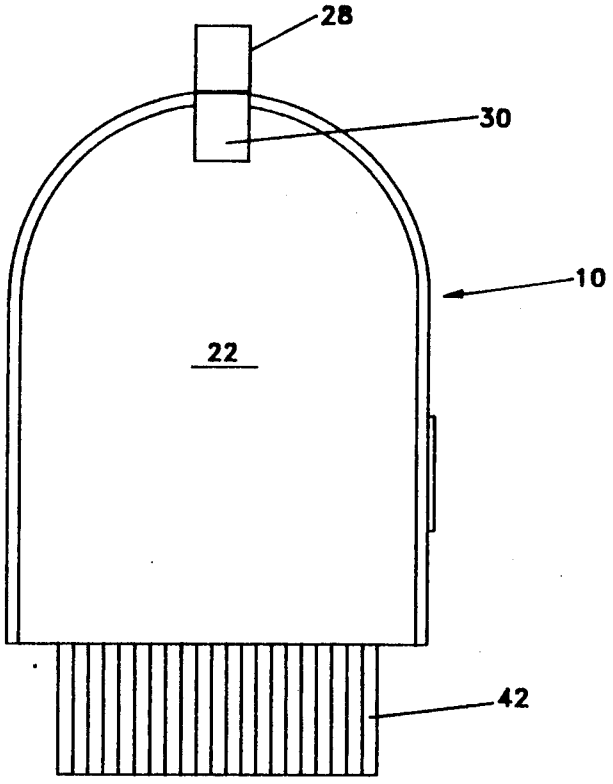
FIG. 7 is a front elevational view of the signal device of FIGS. 1-3 and 5 or FIG. 4 with the door of the mailbox in a closed position, after receipt of mail, with the signal device in its released or signalling position.
Figure 6:
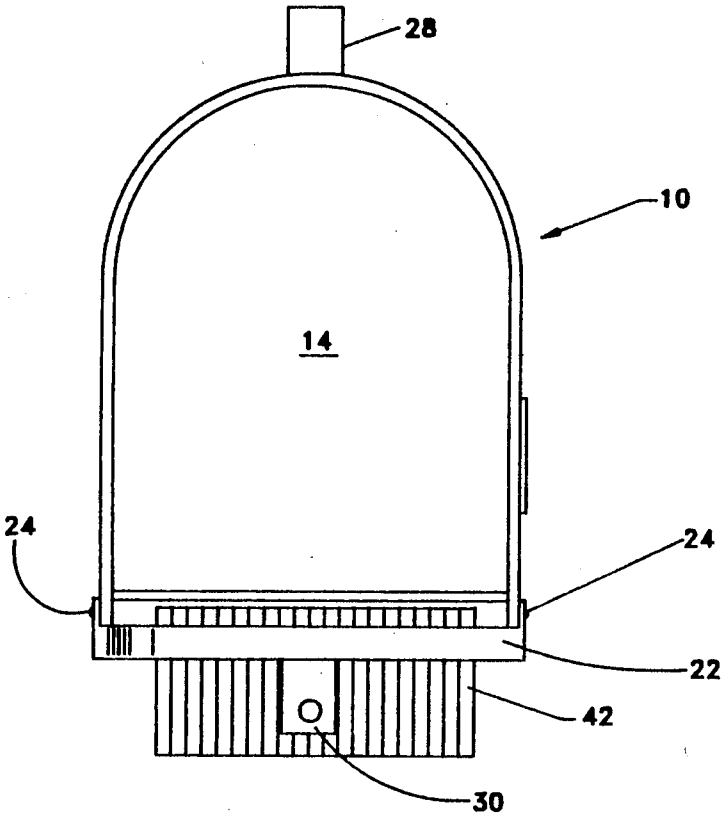
FIG. 6 is a front elevational view of the signal device of FIGS. 1-3 and 5 or FIG. 4 with the door of the mailbox in an opened position with the signal device in its released or signalling position.

FIG. 9 shows the embodiment of signal device 40 of FIG. 4 mounted on a mailbox 10 having a wood board 72 including a tapered end 74 attached to bottom 20 of mailbox 10. The tapered end 74 provides clearance when door 22 is opened about pivot points 24. The other embodiments could likewise be used with conventional mailboxes having a wood board 72 attached thereto.

Figure 10:
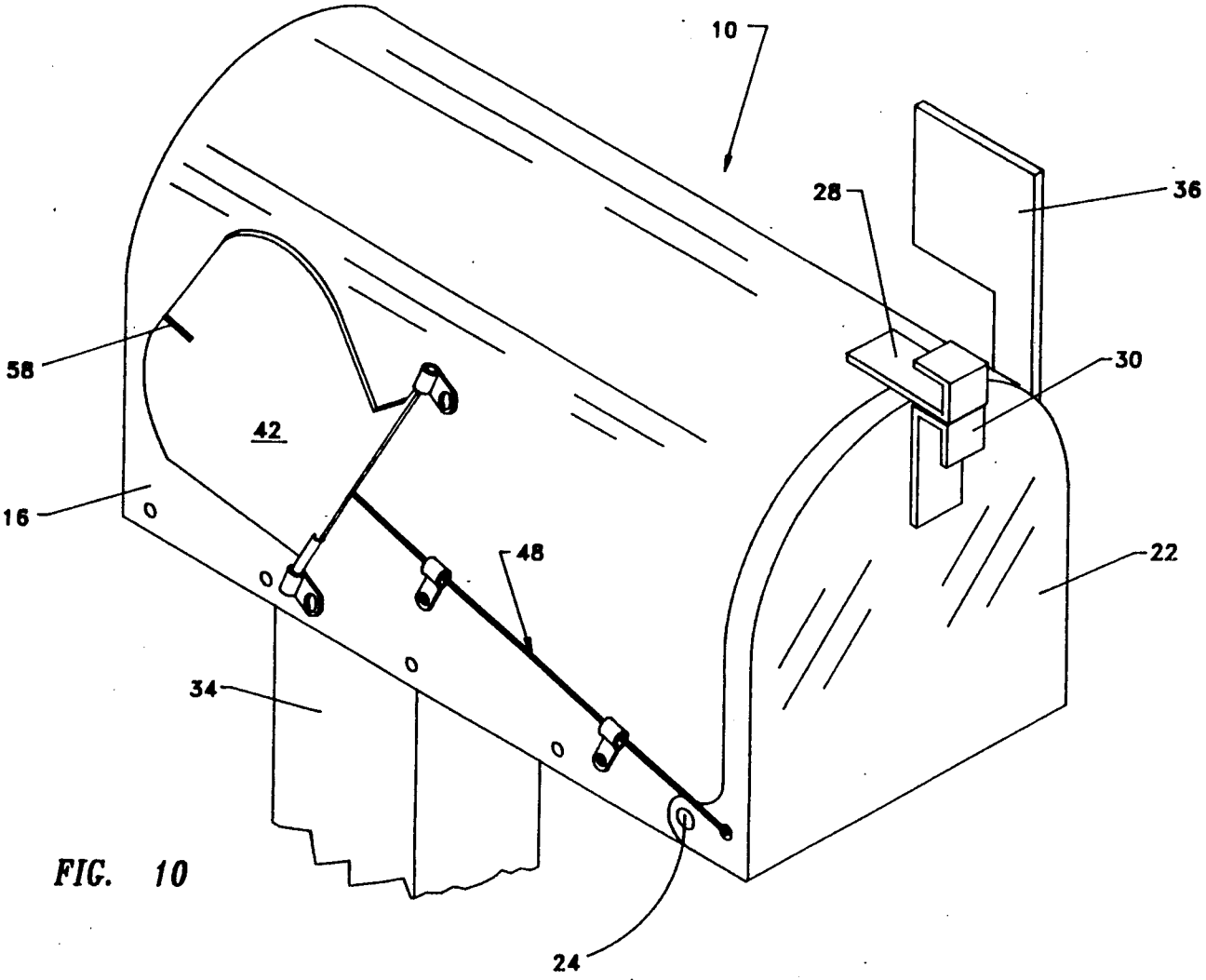
FIG. 10 is a pictorial view of a rural type mailbox illustrating yet another embodiment of a side-mounted signal device with the flag and operating mechanism being shown in its raised or non-signalling position.

The embodiment of the signal device as illustrated in FIG. 10 is similar in many respects to those illustrated in FIGS. 2, 3 and 5 and FIG. 4 except for the fact that the flag plate 42 is mounted on one of the side walls 16, with flag plate 42 being actuated by hook 58 on second end 52 of rigid rod or wire 48. In this embodiment, a spring member (not shown) can be mounted on side wall 16 of mailbox 10 to initially urge flag plate 42 away from side wall 16 before gravity takes over to bring flag plate 42 to its lowered, signalling, position.

Figure 11:
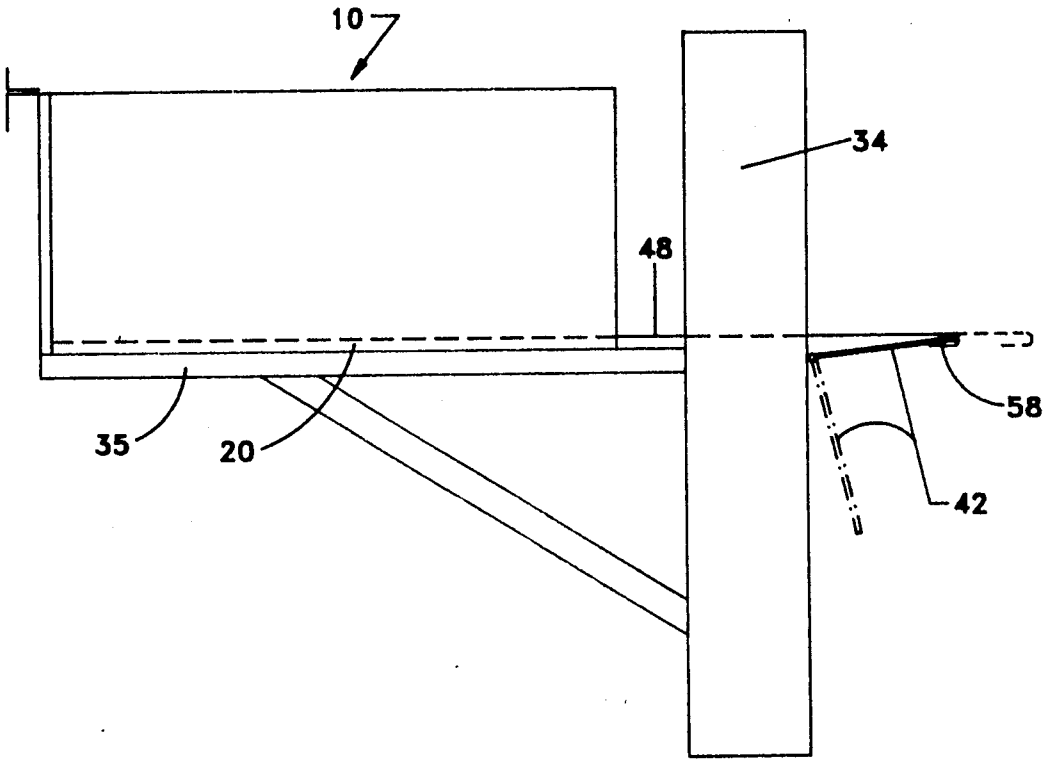
FIG. 11 is a side elevational view of a rural type mailbox shown mounted on a post, provided with yet another embodiment of the signal device of the present invention with the flag and portions of the operating mechanism being shown in solid line in a raised or non-signalling position and the flag and portions of the operating mechanism being shown in dot-dash lines in its released or signalling position.
Figure 12:
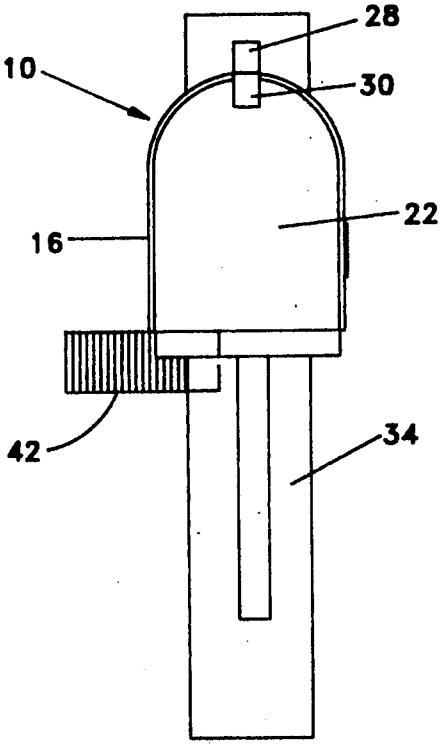
FIG. 12 is a front elevational view of the signal device of FIG. 11 with the door of the mailbox in a closed position, after receipt of mail, with the signal device in its released or signalling position.

The embodiment of the signal device as illustrated in FIGS. 11 and 12 is similar in many respects to those illustrated in FIGS. 2, 3 and 5, FIG. 4 and FIG. 10. In this embodiment, mailbox 10 is mounted on a horizontal support board or plate 35 attached to vertical post 34, flag plate 42 is hingedly attached to vertical post 34 in lieu of being hingedly attached directly to mailbox 10, and rod 48 is longer than in the other embodiments. In the embodiment of FIGS. 11 and 12, rigid rod or wire 48 can be located either on a side 16 or the bottom 20 of mailbox 10 and extend either to the side of vertical post 34 or through an opening (not shown) in vertical post 34.

The operation of the embodiment illustrated in FIGS. 2, 3 and 5 is as follows. When the mail carrier opens door 22 to place mail 70 into box 10, the movement of door 20 about its pivot or hinge points 24 causes rod 48 and its hook 58 to move toward the back wall 14 of the box 10 from the position shown in FIG. 2 to the position shown in FIG. 5 during which movement hook 58 releases flag plate 42 to allow flag plate 42 to fall, due to gravity, from its raised or non-signalling position (FIG. 2) to its released or signalling position (FIG. 5). The mail carrier, after placing mail 70 into box 10, closes door 20 which leaves flag plate 42 in its released or signalling position (FIG. 3) to provide an indication to the owner of mailbox 10 that mail 70 has been placed into box 10. When mail 70 is removed from box 10, the owner (or the person removing mail 70 from the box 10) merely raises the flag plate 42 from its released or signalling position (FIGS. 3 or 5), closes door 22 to cause movement of rigid rod or wire 48 and its hook 58 from the position shown in FIG. 5 to the position shown in FIG. 2 which movement causes hook 58 of rigid wire to extend around edge 41 and engage surface 43 of flag plate 4 to hold flag plate 42 in its raised or non-signalling position (FIG. 2). The operation of the other embodiments is substantially identical to that for the embodiment of FIGS. 2, 3 and 5.

While the above description constitutes preferred embodiments of the present invention, it will be appreciated that the invention is susceptible to modification, variation and change without departing from the proper scope and fair meaning of the accompanying claims and is adaptable for use with mailboxes having structure different from that disclosed in the drawings.

We claim:

1. A self-contained signalling device adapted for attachment to a standard mailbox, said mailbox having a top wall, a bottom, and an open front end capable of being closed by a door pivotally mounted on said mailbox, said signalling device comprising:

indicating means disposed for coaction with said door for displacement between a first, restrained, non-signalling position, and a second, gravity inducted, signalling position;

actuating means including a rod-like member having a first end pivotally secured to said door and a second end disposed for releasably engaging said indicating means, said rod-like member being linearly movable between first and second positions, said first position effecting said restrained, non-signalling, position of said indicating means, and said second position effecting said gravity induced, signalling, position of said indicating means; and pivotal attachment means for pivotally securing said first end of said rod-like member to a predetermined position on said door;

said indicating means being a flag plate having first and second edges and first and second substantially parallel surfaces, said flag plate being hingedly supported adjacent said first edge and restrained in a substantially horizontal non-signalling position responsive to engagement of said flag plate by said second end of said rod-like member in its said first position, said flag plate being disposed for displacement to a substantially vertical position responsive to disengagement of said second end of said rod-like member from said flag plate when said rod-like member is in its said closed position.

2. The self-contained signalling device of claim 1 wherein said door includes a bottom edge and said predetermined position of said pivotal attachment means is located adjacent said bottom edge.

3. The self-contained signalling device of claim 2 wherein said second end of said rod-like member includes a hook for engagement with and disengagement from said second edge of said flag plate.

4. The self-contained signalling device of claim 3 wherein said pivotal attachment means adjacent said bottom edge of said pivotally door includes a hinge member having an opening therein for receiving said first end of said rod-like member.

5. The self-contained signalling device of claim 3 wherein said flag plate is hingedly secured to said bottom of said mailbox.

6. The self-contained signalling device of claim 3 wherein said flag plate is hingedly secured to one of said side walls of said mailbox.

7. The self-contained signalling device of claim 3 wherein said mailbox is secured to a post and said flag plate is hingedly attached to said post.

8. The self-contained signalling device of claim 3 wherein said first end of said rod-like member includes a generally circular hook member, and said pivotal attachment means includes an opening in said door for receiving said hook member of said rod-like member.

9. The self-contained signalling device of claim 8 wherein said flag plate is hingedly secured to said bottom of said mailbox.

10. The self-contained signalling device of claim 8 wherein said flag plate is hingedly secured to one of said side walls of said mailbox.

11. The self-contained signalling device of claim 8 wherein said mailbox is secured to a post and said flag plate is hingedly attached to said post.

12. A self-contained signalling device having a raised, non-signalling position, and a lowered, signalling position, and adapted for attachment to a standard mailbox mounted on a post, said mailbox having a top wall, side walls, a bottom, and an open front end capable of being closed by an outwardly, downwardly, swinging door pivotally mounted thereto, said door having a lip portion which surrounds the outer surface of the forward edges of said side walls and said top wall when said door closes said open front end, said signalling device comprising:

a flag plate disposed for displacement between said non-signalling and signalling positions, said flag plate having a first edge and a second edge;

a plurality of hinges secured to said first edge of said flag plate and to said mailbox for hingedly connecting said flag plate to said mailbox;

means for actuating said flag plate for allowing it to move from its said non-signalling position to its said signalling position, said actuating means including means adjacent the lowermost portion of said swinging door and a rigid element having a first end, a second end and an intermediate portion, said first end of said rigid element being connected to said means adjacent said lowermost portion of said swinging door, said second end of said rigid element having a hook formed at its distal end for engagement with and disengagement from said second edge of said flag plate, whereby upon the opening of said swinging door when said flag plate is in its said non-signalling position, said means adjacent said lowermost portion of said swinging door causes movement of said rigid element to cause said hook to release said second edge of said flag plate to allow it to move from said non-signalling position to said signalling position; and means secured to said mailbox for guiding and supporting said intermediate portion of said rigid element.

13. The self-contained signalling device of claim 12 wherein said flag plate is hingedly connected to said bottom of said mailbox, said means adjacent the lowermost portion of said swinging door includes a half hinge member having an opening therein for receiving said first end of said rigid element, and said means for guiding and supporting said intermediate portion of said rigid element includes a plurality of guide members secured to said bottom of said mailbox.

14. The self-contained signalling device of claim 12 wherein said flag plate is hingedly connected to said bottom of said mailbox, said means adjacent the lowermost portion of said swinging door includes an opening in said door which receives a generally circular hook member on said first end of said rigid element, and said means for guiding and supporting said intermediate portion of said rigid element includes a plurality of guide members secured to said bottom of said mailbox.

15. A self-contained signalling device having a raised, non-signalling position, and a lowered, signalling position, and adapted for attachment to a standard mailbox mounted on a post having a vertical portion and a horizontal portion, said mailbox having a top wall, side walls, a bottom, and an open front end capable of being closed by an outwardly, downwardly, swinging door pivotally mounted thereto, said door having a lip portion which surrounds the outer surface of the forward edges of said side walls and said top wall when said door closes said open front end, said signalling device comprising:

a flag plate disposed for displacement between said non-signalling and signalling positions, said flag plate having a first edge and a second edge;

a plurality of hinges secured to said first edge of said flag plate and to said vertical portion of said post for hingedly connecting said flag plate to said vertical portion of said post;

means for actuating said flag plate for allowing it to move from its said non-signalling position to its said signalling position, said actuating means including means adjacent the lowermost portion of said swinging door and a rigid element having a first end, a second end and an intermediate portion, said first end of said rigid element being connected to said means adjacent said lowermost portion of said swinging door, said second end of said rigid element having a hook formed at its distal end for engagement with and disengagement from said second edge of said flag plate, whereby upon the opening of said swinging door when said flag plate is in its said non-signalling position, said means adjacent said lowermost portion of said swinging door causes movement of said rigid element to cause said hook to release said second edge of said flag plate to allow it to move from said non-signalling position to said signalling position; and means for guiding and supporting said intermediate portion of said rigid element.

16. The self-contained signalling device of claim 15 wherein said means adjacent the lowermost portion of said swinging door includes a half hinge member having an opening therein for receiving said first end of said rigid element, and said means for guiding and supporting said intermediate portion of said rigid element includes guide members secured to said bottom of said mailbox and an opening in said vertical portion of said post.

17. The self-contained signalling device of claim 15 wherein said means adjacent the lowermost portion of said swinging door includes an opening in said door which receives a generally circular hook member on said first end of said rigid element, and said means for guiding and supporting said intermediate portion of said rigid element includes guide members secured to said bottom of said mailbox and an opening in said vertical portion of said post.

* * * * *